United States Patent [19]

Schumacher et al.

[11] Patent Number: 5,004,245

[45] Date of Patent: Apr. 2, 1991

[54] METHOD AND APPARATUS FOR PLAYING A GAME

[76] Inventors: Dean P. Schumacher, 4922 Stamford Dr., West Bloomfield, Mich. 48033; William F. Blume, 26 Gramercy Park South, Apt. 9F, New York, N.Y. 10003; John C. Bonds, 730 N. LaSalle, Chicago, Ill. 60610

[21] Appl. No.: 487,345

[22] Filed: Mar. 1, 1990

[51] Int. Cl.[5] ..... A63F 3/00

[52] U.S. Cl. ..... 273/241; 273/249; 273/285

[58] Field of Search ..... 273/241, 249, 285, 287, 273/251, 272, 288, 248

[56] References Cited

U.S. PATENT DOCUMENTS

| | | | |
|---|---|---|---|
| 3,809,407 | 5/1974 | Quigley | 273/241 |
| 3,858,333 | 1/1975 | Kopp | 273/272 |
| 4,201,388 | 5/1980 | Cantelon | 273/288 |
| 4,278,255 | 7/1981 | Gilbert | 273/248 |
| 4,477,080 | 10/1984 | Baker | 273/241 |

*Primary Examiner*—Benjamin Layno

*Attorney, Agent, or Firm*—Dykema Gossett

[57] ABSTRACT

A method and apparatus is disclosed for the playing of a game disclosing in the preferred embodiment of the invention the use of a multi-level pyramid game board 10 which is collapsible into a generally planar arrangement 52. Dice 78, 80 are used both to determine an amount of movement upon the board 10 as well as the direction associated therewith. Additionally, game players are to do battle by the generation and the later comparison of a plurality of hand symbols 100–104 that define which token, if any, is to be moved upon the game board 10. The invention relates to a method and apparatus for playing a game.

15 Claims, 5 Drawing Sheets

METHOD AND APPARATUS FOR PLAYING A GAME

FIELD OF THE INVENTION

This invention relates to a method and apparatus for the playing of a game, and more particularly to a board game which is relatively fast-paced in nature, requires active physical participation by all of the game players, and which may be played by people of a variety of ages.

DISCUSSION

Many types of games, particularly board games, have gained much popularity in the past. These games have included a game board and have usually required a plurality of players to each move a corresponding game token or piece upon the board in response to a throw of the dice, the shuffling of cards, the rotation of turnable wheels or the like. These tokens may be of a variety of shapes and colors, and each player of the game is usually assigned a unique one of these tokens. The position that these tokens occupy upon the board usually is determinative of the overall "winner" of the game, and the tokens are moved upon the board in accordance with a set of rules or regulations.

While many of these games have enjoyed tremendous popularity upon their initial use, they have oftentimes been criticized as being boring and uninteresting to continued users of the game. This has usually been due to the relative passive requirements placed upon the board game players and the lack of continued uncertainty over the eventual game champion or winner. That is, many of these games have failed to allow a currently "losing" player the opportunity to "win" the game and overtake the current "game leader" very quickly, thereby creating excitement during game play and have failed to actively and physically involve the game participants in the game play.

It is therefore an object of this invention to provide a method and an apparatus for playing a game which requires active and physical participation by substantially all of the game players.

It is another object of this invention to provide a method and an apparatus for playing a game which provides for uncertainty as to the eventual winner of the game for a relatively long period of game-playing time.

It is yet another object of this invention to provide each of the players associated with the game methodology and game apparatus of this invention, one uniquely designated game token which is to be moved upon the game board.

It is a further object of this invention to define the movement of each of the uniquely designated tokens, upon the game board of this invention, by use of a first die and the comparison of hand symbols generated, in a substantially simultaneous manner, by at least two of the game players.

It is yet a further object of this invention to define the direction of movement, by each of the uniquely designated tokens upon the game board, by the use of a second die.

It is also an object of this invention to provide a collapsible game board which may be relatively easily stored and carried when not used for playing the game of this invention.

SUMMARY OF THE INVENTION

According to the teachings of the present invention, a game methodology and apparatus is provided which is fast-paced in nature and requires substantially continual active physical involvement by substantially all of the game player participants.

The game, in the preferred embodiment of this invention, contains a game board which, in one embodiment, has a collapsible pyramid structure which defines multiple levels of play. Each of these levels of play are arranged in a hierarchical manner. A plurality of colored tokens, each of which is uniquely associated with one of the game players, are moved upon this game board in response both to the rolling of dice as well as to the generation and the comparison of hand symbols used by the various game players. The game board further contains a portion in which the colored tokens are moved upon, only in response to the comparison of and the generation of hand symbols among the various game players. The "winner" of the game is defined to be the first of the game players who moves his or her corresponding game token to the top or pinnacle portion of the pyramid before any of the other game players move their corresponding tokens to this point. After the game is completed, the game board is then collapsed such that it becomes substantially planar in shape in order to facilitate ease of storage and transportation thereof.

Further objects, features and advantages of the invention will become apparent from a consideration of the following description and the appended claims when taken in connection with the accompanying drawings.

BRIEF DESCRIPTION OF THE DRAWINGS

Various advantages of the present invention will become apparent to those skilled in the art by reading the following specification and by reference to the following drawings in which.

DETAILED DESCRIPTION OF THIS INVENTION

I. Gameboard Description

Figure 1:
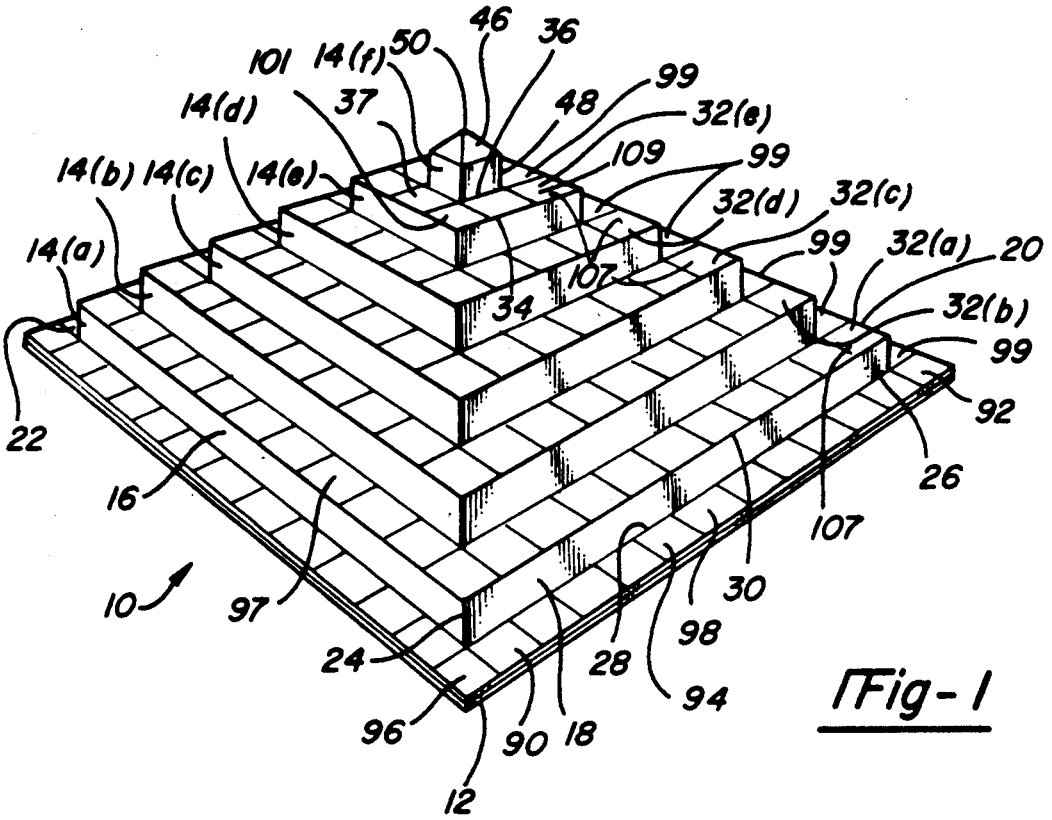
FIG. 1 is a plan view of the game board made in accordance with the teachings of the preferred embodiment of this invention shown in its playable and extended position.

Referring now to FIG. 1, there is shown a game board 10 made in accordance with the teachings of the preferred embodiment of this invention and shown in its fully extended and playable position. In this position, game board 10 defines a general pyramid shape. Game board 10 contains a planar and generally square-shaped base portion 12 upon which a pluarlity of movable members 14(*a*), 14(*b*), 14(*c*), 14(*d*), 14(*e*), and 14(*f*) hierarchically reside above. Each movable member 14 (*a*)–(*f*) contains vertically extending planar members 16, 18, 20, and 22. Each vertically extending planar member 16, 18, 20, and 22 defines vertical edge portions 24 and 26 and horizontal edge portions 28 and 30 thereon.

Edge portion 24 of members 16 and 18 are connected as are edge portions 26 of members 16 and 22, edge portions 26 of members 18 and 20, and edge portions 24 of member 22 and 20, for each of the movable members 14(*a*), 14(*b*), 14(*c*), 14(*d*), 14(*e*), and 14(*f*). This aforedescribed interconnection of vertical edge portions allows horizontal edge portions 30 of members 16, 18, 20, and 22 of each of the movable members 14(*a*), 14(*b*), 14(*c*), 14(*d*), 14(*e*), and 14(2*f*) to each cooperatively define a single, substantially continuous square shaped edge. This vertical edge interconnection also allows horizontal edge portions 28 of members 16, 18, 20, and 22 of each of the movable members 14(*a*), 14(*b*), 14(*c*), 14(*d*), 14(*e*) and 14(*f*) to each cooperatively define a single, substantially continuous square shaped edge portion.

Each of the movable members 14(*a*), 14(*b*), 14(*c*), 14(*d*), and 14(*e*) further contains a substantially square shaped and generally planar member 32(*a*)–(*e*), respectively. Each member 32(*a*)–(*e*) defines a substantially continuous and square shaped outer edge portion 34 and a substantially continuous and square shaped inner edge portion 36 which as physically separated and defined by a square shaped planar surface 37. Edge portions 34 of each of the members 32(*a*)–(*e*) are connected to the single, substantially continuous square shaped edge 30 defined by horizontal edge portions 16, 18, 20, and 22 of the member 14(*a*), 14(*b*), 14(*c*), 14(*d*), or 14(*e*) that each of the individual members 32(*a*), 32(*b*), 32(*c*), 32(*d*), or 32(*e*) is uniquely associated with.

Figure 3:
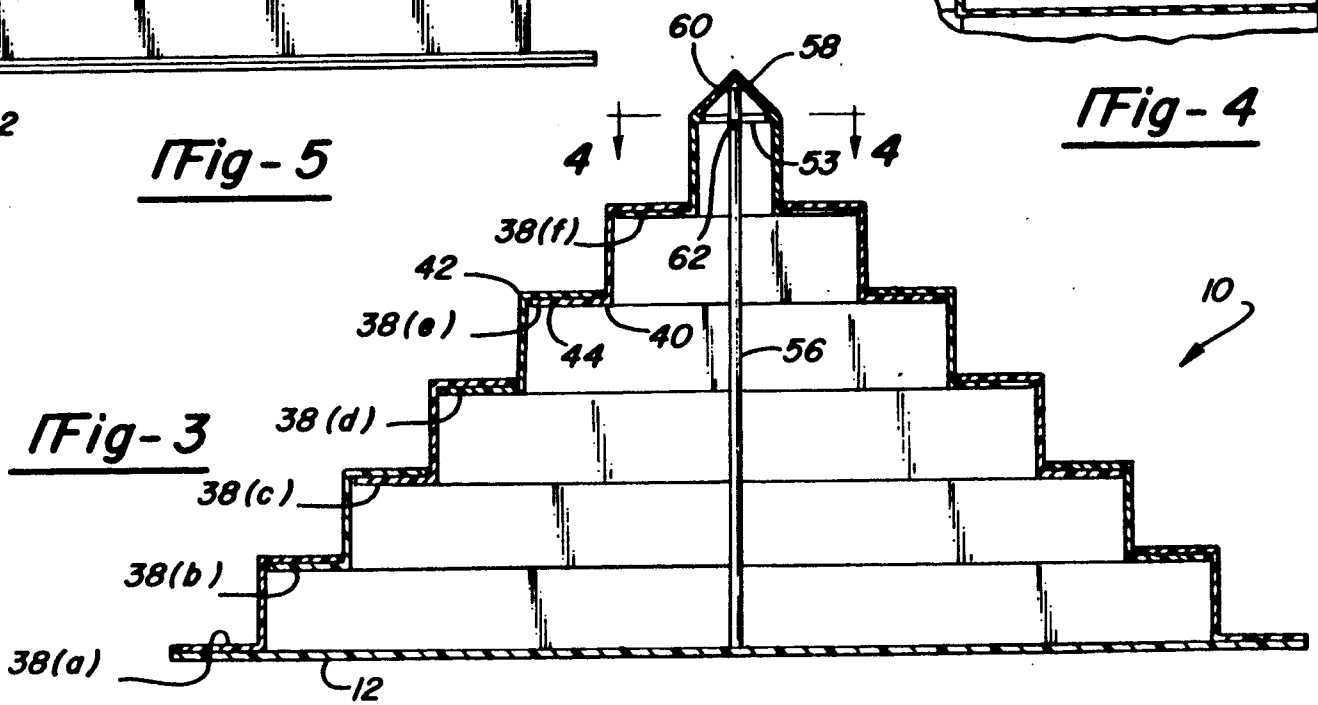
FIG. 3 is a side view of the preferred embodiment of the game board generally shown in FIG. 1.

Further, each of the movable members 14(*a*), 14(*b*), 14(*c*), 14(*d*), 14(*e*) and 14(*f*) further contains a substantially square shaped and planar member 38(*a*)–(*f*), respectively (FIG. 3). Each member 38(*a*)–(*f*) defines a substantially continuous and square shaped inner edge portion 40 and a substantially continuous and square shaped outer edge portion 42 which are physically defined and separated by a generally square shaped planar surface 44. Edge portion 40 of each of the members 38(*a*)–(*f*) are connected to the single, substantially continuous square shaped edge defined by the interconnection of horizontal edge portions 28 which are themselves defined by the horizontal edge portions 16, 18, 20, and 22 of each of the members 14(*a*), 14(*b*), 14(*c*), 14(*d*), or 14(*e*) that the individual member 38(*a*), 38(*b*), 38(*c*), 38(*d*), or 38(*e*) is associated with. In the preferred embodiment of the invention, game board 10 is constructed of commonly used cardboard and all of the aforementioned connections may be accomplished by the use of glue. However, other materials, such as plastic or wood, may be used to construct game board 10 and other standard metods of interconnection, such as by using mechanical pins, may be employed.

Game board 10 contains a hollow top member 46 having a substantially square base portion 48 which, in the preferred embodiment of this invention, is removably connected to edge 30 of movable member 14(*f*). Top member 46 further contains a substantially triangular cross sectional area and defines a pinnacle portion 50 which is the farthest point, upon member 46, from the substantially square base portion 48.

Figure 8:
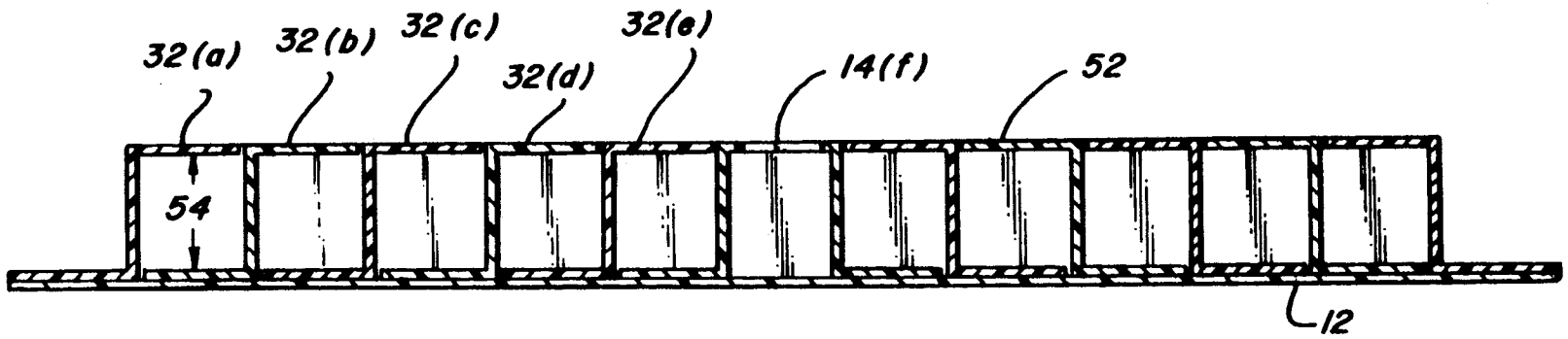
FIG. 8 is a side view of the game board shown generally in FIG. 1 being fully collapsed.

Game board 10 is assembled by initially securing planar surface 44 of member 38(*a*) to base 12 (FIG. 3) and then removably placing planar surface 44 of member 38(*b*) onto base 12 such that it substantially resides under surface 37 of member 32(*a*). Planar surface 44 of member 38(*c*) is then removably placed unto base 12 such that it substantially resides under surface 37 of member 32(*b*) and planar surface 44 of member 38(*d*) is then removably placed upon base 12 such that it substantially resides under surface 37 of member 32(*c*). Planar surface 44 of member 38(*e*) is then removable placed upon base 12 such that it substantially resides under surface 37 of member 32(*d*). Finally, planar surface 44 of member 38(*f*) is then removably placed upon base 12 such that it substantially resides under surface 37 of member 32(*e*). In this manner, game board 10 defines a collapsed configuration as shown in FIG. 8. In this collapsed configuration, planar surface 37 of members 32(*a*), 32(*b*), 32(*c*), 32(*d*), and 32(*e*) and member 14(*f*) cooperate to form a generally planar surface 52 which is separated from base 12 by a distance 54 substantially equal to the length of edge portions 24 or 26. In the preferred embodiment of this invention, the length of all edge portions 24 and 26 are substantially equal. It should be readily apparent, to one of ordinary skill in the art, that this collapsed configuration allows game board 10 to be relatively easily stored and transported.

Reference is now made to FIG. 3 where game board 10 is shown in its playable, extended state such that game board 10 defines a substantially pyramid shape. As seen, in the preferred embodiment of this invention, member 46 (FIG. 1) is made to partially contain a rounded and elongated member 56 which is made to extend outwardly from pinnacle portion 50. Member 56 may be secured within member 46 by usual methods such as the gluing of member 56 within member 46 at points 58 and 60 of contact therein. Further, in the preferred embodiment of this invention, member 56 is further made to contain a rounded member 62 which horizontally passes through member 56 such that it frictionally engages top member 46 of member 14(*f*) at the bottom surface 53 thereof. Member 62 may be partially secured within member 56 by usual methods such as gluing.

Figure 2:
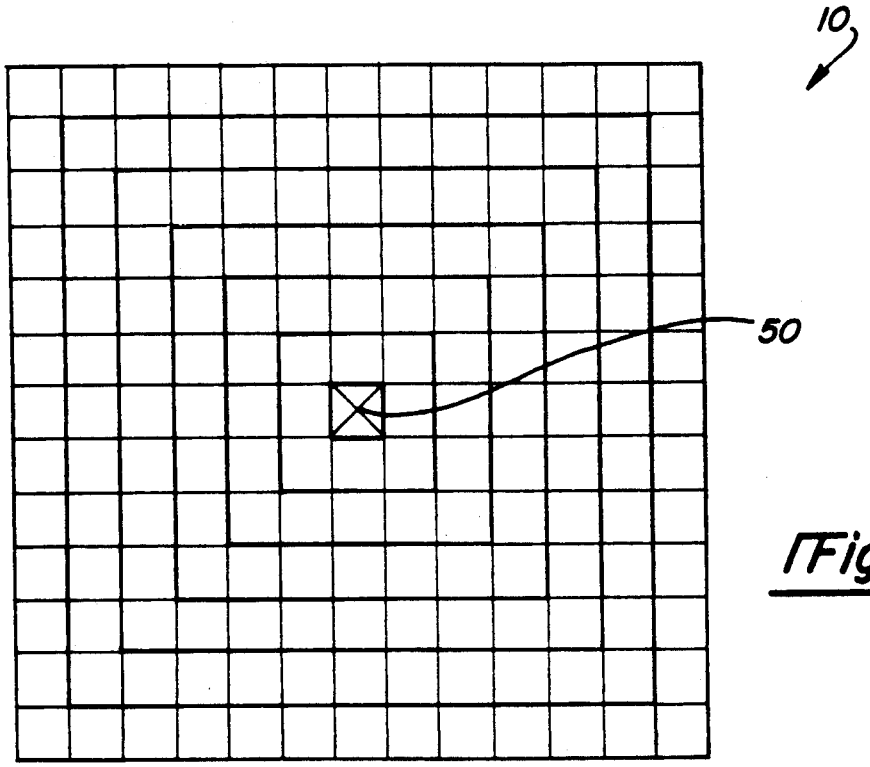
FIG. 2 is a top view of the game board as shown in FIG. 1.
Figure 4:
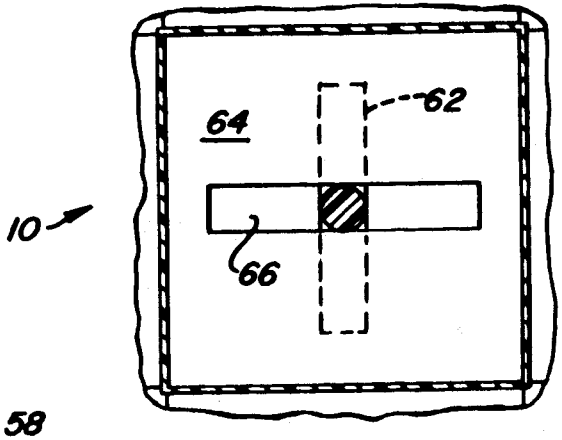
FIG. 4 is a view of the game board shown generally in FIG. 3 and taken along line 4—4' therein.
Figure 5:
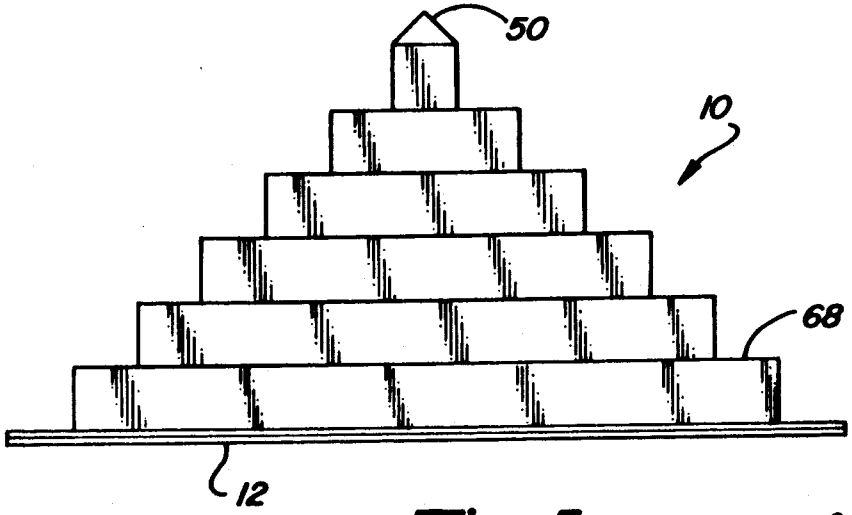
FIG. 5 is a side elevation of the game board shown generally in FIG. 3.

In the preferred embodiment of this invention, as shown in FIG. 4, top member 46 contains a generally planar top surface 64. Surfaces 53 and 64 cooperate to define a generally rectangular opening 66 therethrough. In order to extend game board 10 from the collapsed position shown in FIG. 8 to the playable position shown in FIG. 3, member 14(*f*) is grasped and upwardly pulled by one of the game players. Upon the full extension of game board 10, shown in FIG. 3, member 46 is placed over member 14(*f*) such that member 62 is received by opening 66 and passes therethrough while member 56 vertically engages base 12 and is made to reside within game board 10 in an upright extended position. Thereafter, member 56 is rotated such that member 62 is transversely positioned across opening 66 and frictionally and supportively positioned underneath surface 64. That is, member 62 engages surface 53. In this manner, game board 10 is fixed in the position shown in FIG. 3. As shown in FIG. 5, each of members 32(*a*), 32(*b*), 32(*c*), 32(*d*), 32(*e*) and top member 46 defines a unique "level of play" 68. Further, as shown in FIG. 2, the pinnacle portion 50 in the preferred embodiment of this invention, is made to extend above base 12.

Figures 6, 9:
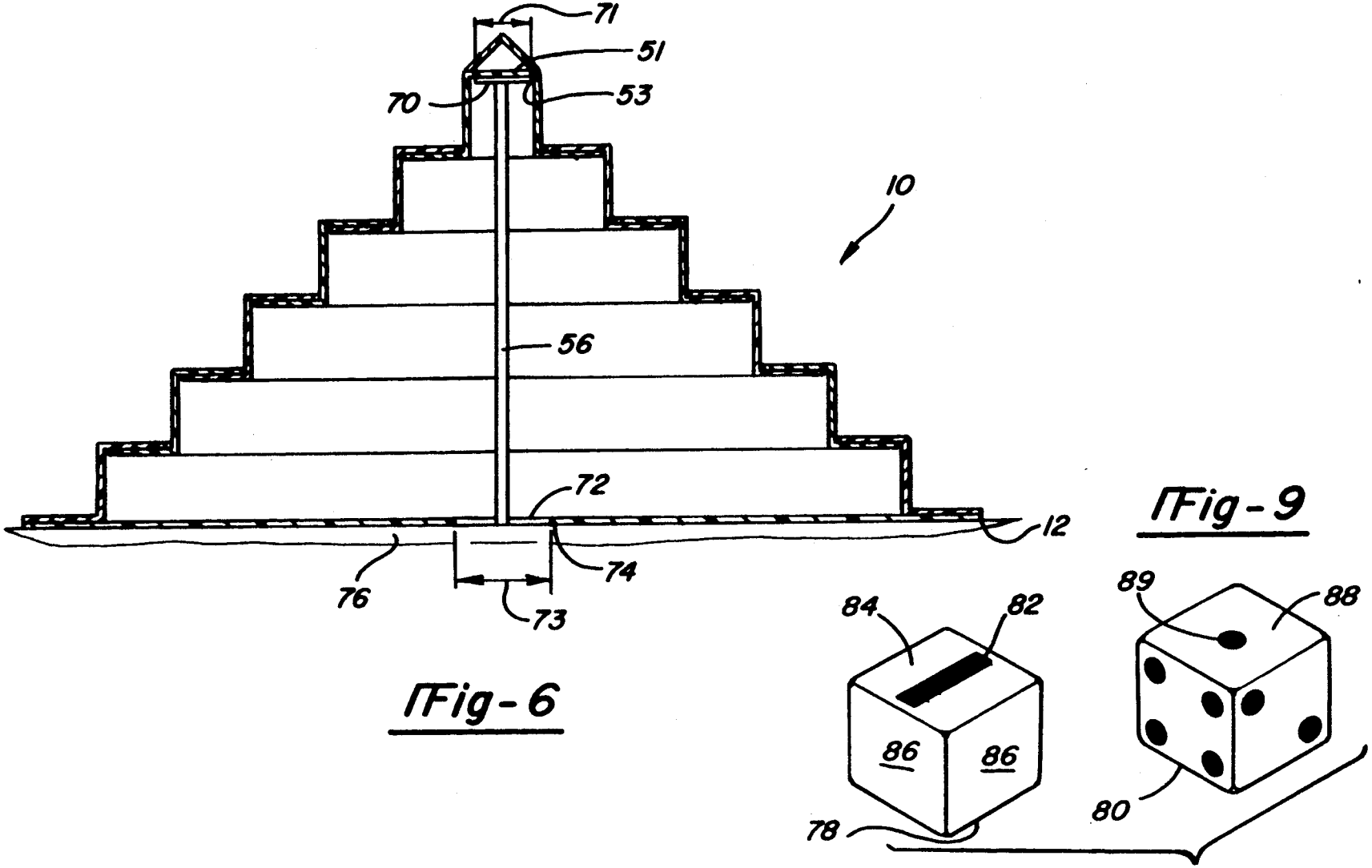
FIG. 6 is a side view of an alternative embodiment of a game board made in accordance with the teachings of this invention.
FIG. 9 is an illustration of dice made in accordance with the teachings of the preferred embodiment of this invention and used in conjunction with the game board which is shown generally in FIG. 1.

In one alternative embodiment, as shown in FIG. 6, member 56 is made to contain horizontal members 70 and 72 at opposite ends thereof and which may be secured to member 56 by such standard techniques such as gluing. Member 70 is defined to have a length 71 which is smaller than length 73 of member 72. Base 12 is made to contain an opening 74, slightly smaller in length than the length 73. Member 70 is made to be placed through opening 74. In this manner, member 70 supportively engages the opposite side of the bottom surface 53 of member 46 such that game board 10 is fixed in the extended position shown in FIG. 6. In this embodiment, member 72 substantially fills opening 74 and rests upon surface 76 (i.e., a table top) as does base 12.

To bring game board 10, of FIGS. 3 and 6, to the collapsed state shown in FIG. 8, member 56 is first removed (in either of the embodiments show in FIGS. 3 and 6) and movable members 14(*a*), 14(*b*), 14(*c*), 14(*d*), 14(*e*) and 14(*f*) automatically are moved by gravitational force such that members 32(*a*), 32(*b*), 32(*c*), 32(*d*), 32(*e*) and 14(*f*) are positioned in their respective positions upon base 12 as shown in FIG. 8.

Figure 7:
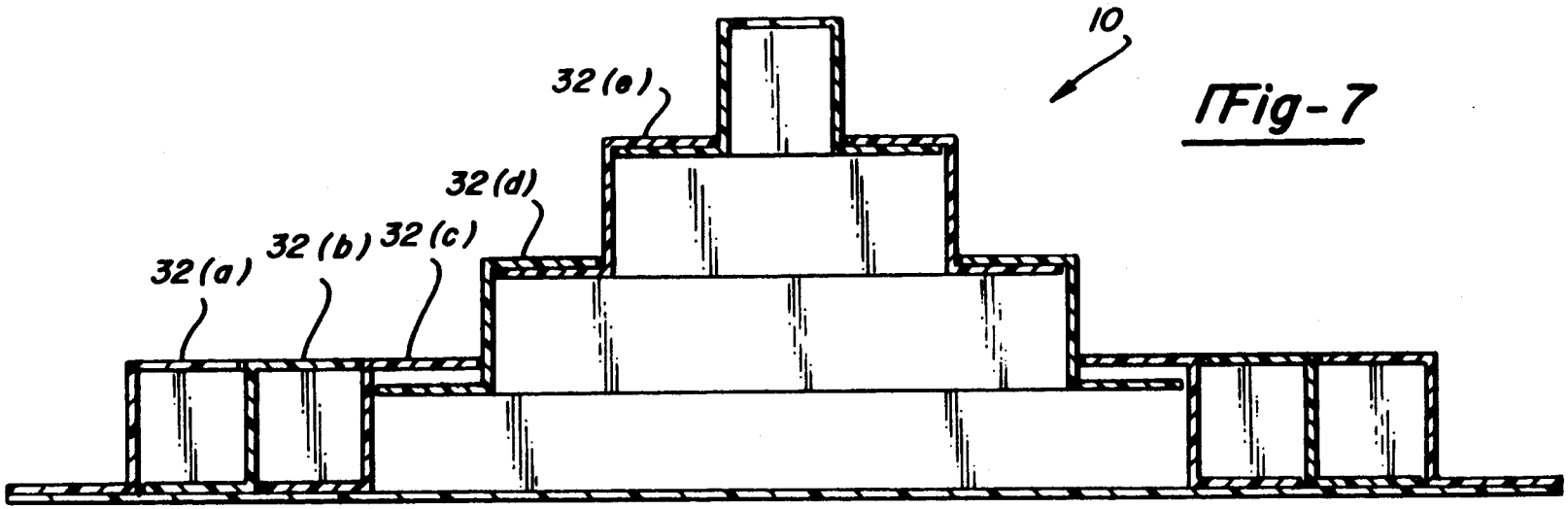
FIG. 7 is a side view of the game board shown generally in FIG. 1 in a partially collapsible state.

Specifically, member 56 is removed from within game board 10, in the embodiment shown in FIG. 6, by the elevation of game board 10 off of surface 76. Member 56 will then exit game board 10 through opening 74. Member 56 is removed from within game board 10, of the embodiment shown in FIG. 3 by the twisting or rotating of member 46 such that member 62 is made to be received by opening 66. Upon this reception, member 46 is pulled from game board 10 and the resulting collapsed state, shown in FIG. 8, is achieved after game board 10 achieves the partially collapsed state as shown in FIG. 7.

The game methodology, of the preferred embodiment of this invention further contains dies 78 and 80 and a plurality of game tokens (not shown) which may be of any desired geometric shape, each having a single unique color associated therewith. Die 78 is made to contain a generally rectangular symbol 82 on one of its faces 84 while having all other faces 86 being of substantially the same single color which may also be arbitrarily chosen. In one embodiment of this invention this color is black. Die 80 is a typical die having typical faces 88, each containing one of a plurality of dot symbols 89 thereon.

Each of the surfaces 37 of members 32(*a*), 32(*b*), 32(*c*), and 32(*d*) and base 12 are made to contain substantially square-shaped token spaces 90, 92, 94, 96, 97, 98, 99 and 107. Surface 37 of member 32(*e*) is made to contain substantially square-shaped token spaces 101. Each of the token spaces 90–101 and 107 are of substantially the same shape and dimensional size. All of these token spaces 90–101 and 107 may be directly drawn upon game board 10 or placed thereon by other typical artistic techniques. It should be noted that the exact placement or the occurrences of token spaces 90 and 94–98 upon game board 10 is not critical to the proper playing of the game of this invention as long as there is at least one occurrence of each of these token spaces 90 and 94–98. All of the token spaces 90–101 and 107 will be explained further. In the preferred embodiment of this invention there are approximately 169 token spaces upon board 10 of which there are 76 occurrences of token space 90, 19 occurrences of token space 96, 20 occurrences of token space 98, 18 occurrences of token space 94, 18 occurrences of token space 98, 8 occurrences of token space 101, 1 occurrence of token space 92, 5 occurrences of token space 99, and 4 occurrences of token space 107.

II. Initialization

Initially, each of the game players chooses a single one of the game tokens, and these chosen tokens remain uniquely associated with each of the game players throughout the course of game play. Each of the game players then occupies a unique position around the board 10. This position remains uniquely associated with each of the game players for the duration of the game. These tokens are all placed upon token space 92 which is defined to be the "start" or initial token space. Each of the game players then bow to each other as a sign of mutual respect and then proceed to determine the sequence of play. Specifically, each of the game players proceeds to sequentially roll die 80 upon surface 76 and to read the number of dots associated with dot symbol 89 appearing on its uppermost face 88 after the rolling ceases. The order in which each of the players rolls the die 80 is random, and should die 80 fall from surface 76 during its rolling motion, the symbol 89 on uppermost face 88 is disregarded, and it is made to be rolled again by the same player who caused the die 80 to fall from surface 76.

Each of the game players then compares the number of dots associated with the uppermost face 88 that they obtained on their roll of die 80. The player with the highest number of dots on uppermost face 88 is designated as the first player, and each of the other players are sequentially ranked in their order of play relative to their position around the board. That is, the player having the highest number of dots on face 88 is followed in play by the player positioned to his or her immediate left. Play progresses in a clockwise manner around board 10 such that the next player is always defined to be that player positioned to the immediate left of the player whose turn has just ended. Should two or more players have the same amount of dots on uppermost face 88 during their aformentioned throw of die 80 and these players had the largest amount of dots of any of the other players, they would all sequentially throw die 80 again until they all had different amounts of dots associated with symbol 89 on uppermost face 88. The player having the largest amount of dots on uppermost face 88 would then be designated as the first player and the rotation of play would be in a clockwise direction as earlier specified. This ranking or game turn sequence remains constant throughout play and, in the preferred embodiment of this invention, approximately two to six players are to participate in the game. Upon the determination of the sequence of play, the game initialization process ends.

III. Hand Symbols

Figure 10A:
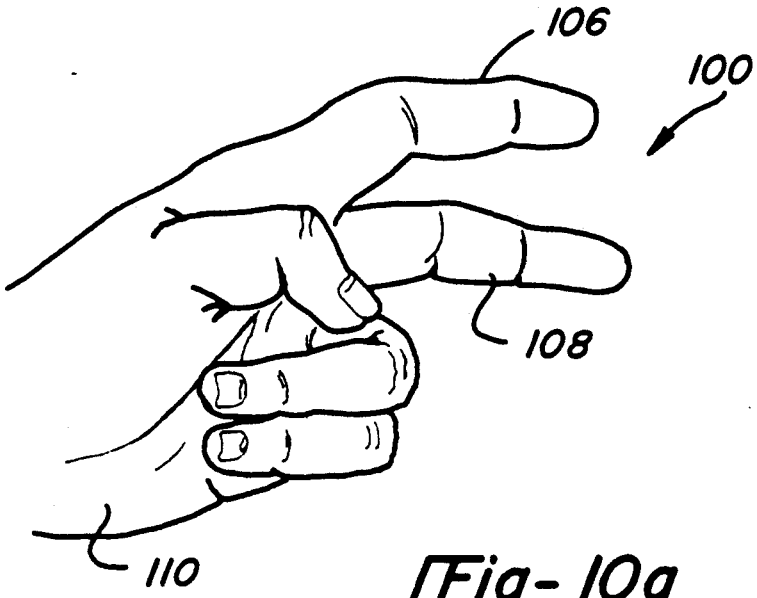
FIGS. 10 (*a*)–(*c*) are illustrations of hand symbols used by the game methodology of the preferred embodiment of this invention.
Figure 10B:
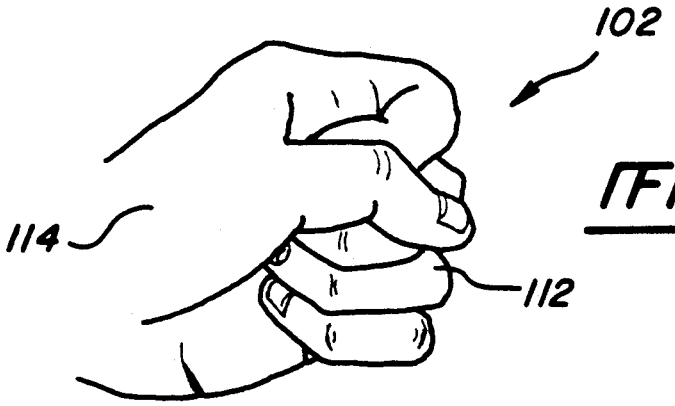
Figure 10C:
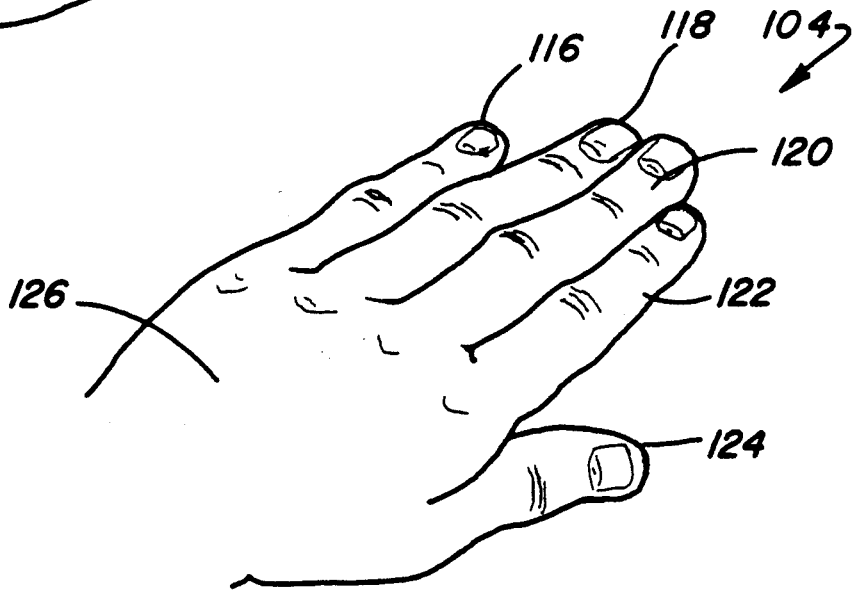

In order to fully understand the procedures of this game, a discussion will now follow relative to the use of a number of hand symbols 100, 102 and 104 as shown in FIGS. 10(*a*)–(*c*) respectively. Specifically, hand symbol 100 is created by the extension of two fingers 106 and 108 of hand 110 and is representative of "scissorsk." Hand symbol 102 is created by the formation of a typical fist 112 by hand 114 and is representative of a "rock," while hand symbol 104 is created by the extension of thumb 116 and fingers 118, 120, 122, 124 of hand 126 and is representative of "paper." The use of these hand symbols 100, 102, and 104 will now be explained in detail relative to their use in "battle."

IV. Battle

"Battle" is defined by the game methodology of the preferred embodiment of this invention as occurring between two of the game players and is accomplished by these two battle participants (i.e. game players) extending one of their hands in the form of a typical first. Both of these players then simultaneously move their extended first up and down approximately three times each. Upon the third and last downward movement of each of their extended fists, each of the battle participants generates one of the previously defined hand symbols 100, 102 and 104 in a substantially simultaneous manner.

The "battle" victor is defined according to the following:

(a) symbol 102 "beats" symbol 106 (i.e. "rock" beats "scissors");

(b) symbol 106 "beats" symbol 104 (i.e. "scissors" beats "paper"); and (c) symbol 104 "beats" symbol 102 (i.e. "paper" beats "rock").

The use of the battle comparison will be described in greater detail in the discussion centering upon actual game play.

It should further be noted that in some situations, which will be described in detail later, a "two-handed combat" or "battle" is accomplished. That is, these two game players generate symbols 100, 102 or 104 in the aforedescribed manner with both of their hands. The symbols from opposite hands (i.e. the left hand of the first game player battle participant and the right hand of the second game player battle participant and the right hand of the first game player battle participant and the left hand of the second game player battle participant) are individually compared in the manner set forth above. If symbols generated by the opposite hands are exactly the same, new symbols are generated as described earlier. Each of the opposite hand comparisons in this "two-handed combat" situation define a separate battle. The use of the "two-handed combat" will be described herein later.

V. Dice

Before describing the actual game playing methodology of the preferred embodiment of this invention, it will be necessary to describe the use of dies 78 and 80. After game initialization is completed, die 80 is generally used to define an amount of movement across game board 10 by a token, while die 78 is used to define a direction that the token is to be moved upon board 10.

A player normally begins his turn by throwing or rolling both of the dies 78 and 80. The uppermost face (84 or 86) of die 78 and the uppermost face 88 of die 80 are then examined. The number of dots defined by symbol 89 of face 88 determines the number of token spaces 90–99, 107 to be traversed. If the uppermost face of die 78 is defined by face 84, having generally rectangular symbol 82 thereon, then the token is moved in a counterclockwise direction across game board 10 by the number of token spaces 90–99, 107 defined by symbol 89. If any of the other faces 86 are uppermost, then this direction of token movement is clockwise. It should be noted that in the preferred embodiment of this invention, symbol 82 appears only on a singe face 84 of die 78 and that the other faces 86 define substantially the same color of black. Further, it should be noted that once a game token has been duly positioned upon any of the token spaces 101, dies 78 and 80 are no longer used to define any further movement for this token because the increment and direction have already been established for that term and will remain constant throughout that player's turn. This "Hand to Hand Combat Zone", associated with spaces 101, will be herein explained later.

VI. Game Play

It should first be noted that the game play differs depending upon the presence or absence of a player's token upon surface 32(*e*) and token spaces 101 thereon. The following discussion assumes that none of the game players have a token upon surface 32(*e*). A player begins his or her turn in sequential order as previously defined by usually rolling both dies 78 and 80. If the player's token is currently on token space 92 and if face 84 having symbol 82 thereon is the uppermost face of die 78, then that player's turn is ended and no movement of his or her token is accomplished. Otherwise, the player's token is moved by an amount of token spaces 90–99, 107 defined by symbol 89 and in the direction associated with die 78.

It should be realized at this point that the general object of this game methodology is to move a token from token space 92 across game board 10 and eventually to pinnacle portion 50. This movement must be accomplished in a clockwise manner. Therefore, any intermediate counterclockwise movement of any of the game tokens represents movement that is detrimental to this objective as it introduces additional token spaces 90–99, 107 that must be re-traversed in a clockwise direction. The movement of the game tokens occurs across each of the plurality of levels 68. That is, each of the game tokens upon reaching token space 99 in a clockwise direction are directed to be moved upward to the token space 107 of the next higher level 68 of game board 10. If the tokens reach token space 107 in a counterclockwise direction, the tokens are moved to the token space 99 of the next lower level 68 of game board 10. Token spaces 99 and 107 are similar to the token spaces 90 to be discussed, and should be regarded as examples thereof.

Upon moving his or her token to the token space defined by dies 78 and 80, the player then determines the type of token space 90–99 101 or 107 that the token now resides upon. If the token is made to reside upon a token space 94, then that player's turn is immediately ended, the token remains upon the token space 94, and the next player in sequence begins his or her turn.

If the token is made to reside upon a token space 90, during that player's turn, the game player must discern the color associated therewith. If the color of token space 90 is substantially the same color as that player's token, then the player moves the token by an additional amount of token spaces 90–99, 107 and in the direction associated with the previously rolled dies 78 and 80.

If the token space 90 has a color which is not associated with any of the colors of tokens used by any of the current game players, then the player (i.e. "the choosing player") selects any of the other players (i.e. "the chosen player") to do single-handed battle with in the manner previously described. If the direction associated with die 78 is clockwise and if the chosen player loses the battle, the token of the choosing player is moved by an amount and in a direction currently associated with dies 80 and 78 respectively. The choosing player's turn continues by discerning the type of token space 90–99, 101 or 107 that his or her token now resides upon and acting in accordance with the game methodology associated therewith. If the chosen player wins the battle and the direction associated with die 78 is clockwise, the token of the choosing player remains stationary, the choosing player's turn is ended, and the token of the chosen player is moved by a number of token spaces 90–99, 107 and in a direction currently associated with dies 80 and 78 respectively. The next player in sequence then begins his or her turn.

If the direction associated with the die 78 is counterclockwise and if the choosing player wins the battle, then the token of the chosen player is moved by an amount and in a direction currently associated with dies 80 and 78 respectively. The token of the choosing player remains stationary, and his or her turn is ended. The next player in sequence then begins his or her turn.

If the direction associated with the die is counterclockwise, and if the chosen player wins the battle, then the token of the choosing player is moved by an amount and in a direction currently specified by dies 80 and 78 respectively, and the turn of the choosing player continues by discerning the type of token space 90–99, 101 or 107 that his or her token now resides upon and acting in accordance with the game methodology associated therewith.

If the game player's token is made instead to reside upon a token space 90 having a color substantially similar to the color of a token of another game player, the two players do single-handed combat in accordance with the previously described methodology. The game player whose turn it is may be referred to as the "attacking warrior," and the other game player may be referred to as the "defending warrior."

If the direction associated with die 78 is clockwise and if the attacking warrior wins the battle, then the turn of the attacking warrior is continued and his or her token is moved by the amount and in a direction currently specified by dies 80 and 78 respectively. If the defending warrior wins the battle, then the token of the attacking warrior remains stationary, and his or her turn is ended. The token of the defending warrior is then moved in a direction and an amount specified by dies 78 and 80. However, if the token of the defending warrior prior to battle resided upon a token space 96, the token is then moved to the first token space 96 encountered while moving the token in a clockwise manner around game board 10. If no such token spaces 96 exist, then the token is moved to the first space 109 of spaces 101 on surface 32(*e*). The next player in sequence then begins a turn.

If the direction associated with die 78 is counterclockwise and if the attacking warrior wins the battle, then the defending warrior's token is moved in a counterclockwise direction across game board 10 by a number of token spaces 90–99, 107 associated with die 80. However, if the defending warrior's token is currently upon a token space 96, then the defending warrior's token is moved in a counterclockwise direction around game board 10 until a token space 96 is encountered. If no such token space 96 is encountered, the token of the defending warrior is placed on token space 92. In any event, the turn of the attacking warrior is ended, and the next player in sequence begins his turn in the manner described herein.

If the direction associated with die 78 is counterclockwise and if the defending warrior wins the battle, then the token of the attacking warrior is moved in a counterclockwise direction across game board 10 by the number of token spaces 90–99, 107 associated with die 80. The turn of the attacking warrior is continued in accordance with the token spaces 90–99 101 or 107 that the attacking warrior's token is now currently residing upon.

If, during the course of play, the token of a game player is made to reside upon a token space 98 which is referred to as the "Warrior Inversion" token space and no other tokens are present on any other token spaces 98, the turn of the player is ended, and the player's token remains on the token space 98. The next player begins his or her turn accordingly.

If, however, during the course of a turn of play a game player's token is made to reside upon a token space 98 and another game player's token is resident on another token space 98, the game player whose turn it is may elect to end his or her turn and allow the associated token to remain upon the token space 98, or the game player may elect to become an "attacking warrior." That is, the attacking warrior may choose to do single-handed battle with any other game player (i.e. the "defending warrior") having a token on a different token space 98. The battle is accomplished as previously described.

The tokens of the attacking warrior and the defending warrior are positionally substituted upon game board 10 if the attacking warrior wins the battle. The turn of the attacking warrior is then ended, and the next sequential player begins play. If the defending warrior wins the battle, then the token of the attacking warrior remains stationary, while the token of the defending warrior is moved by the amount of token spaces 90–99, 107 and in a direction associated with dies 80 and 78 respectively. The turn of the attacking warrior is ended, and the next player in sequence begins his or her turn.

If, during the course of a turn of play, a game player's token is made to reside upon a token space 96, the player may elect to end his or her turn while leaving the token upon the space 96 or, alternatively, do single-handed battle with any of the other game players (i.e. the "defending warrior") in accordance with the aforedescribed methodology. If the current direction associated with die 78 is clockwise and if the attacking warrior wins the battle, the token of the attacking warrior is moved in a clockwise direction across game board 10 by the number of token spaces 90–99, 107 associated with die 80, and the turn of the attacking warrior is continued according to one of the token spaces 90–99 and 107 that the token is now residing upon.

If the direction associated with die 78 is clockwise and if the defending warrior wins the battle, the token of the defending warrior is moved in a clockwise direction across game board 10 by the number of token spaces 90–99 or 107 associated with die 80, and the turn of the attacking warrior is ended. The turn of the next sequential player begins. The token of the attacking warrior remains stationary and his or her turn is ended.

If the direction associated with die 78 is counterclockwise and if the attacking warrior wins the battle, the token of the defending warrior is moved in a counterclockwise direction across game board 10 by the number of token spaces 90–99, 107 associated with die 80. The token of the attacking warrior remains stationary, and the turn of the attacking warrior is ended. The turn of the sequentially next player begins.

If the direction associated with die 78 is counterclockwise and if the defending warrior wins the battle, the token of the attacking warrior is moved across game board 10 in a counterclockwise direction by the number of token spaces 90–99, 107 associated with die 80. The turn of the attacking warrior continues in accordance with the token space 90–99, 101 or 107 that the attacking warrior's token currently resides upon.

If, during the course of a turn of play, a game player's token is made to reside upon token space 97, the game player must engage in double-handed combat as the attacking warrior (as previously described) with one of the other game players having a token whose color matches the color of the token space 97 that the token of the attacking warrior resides upon. If none of the other game players have a token similar to this color, then the attacking warrior selects any of the other game players to do double-handed combat with as a "defending warrior."

If the attacking warrior wins one victory and ties the other battle, then the token of the attacking warrior is moved by the amount of token spaces 90–99, 107, and by the direction associated with dies 80 and 78 respectively. The token of the defending warrior remains stationary, and the turn of the attacking warrior continues in accordance with the new token space 90–99, 101 or 107 that the token now resides upon.

If the attacking warrior wins two victories, then its token is moved by double the amount of token spaces 90–99, 107, and by the direction associated with dies 80 and 78 respectively. The token of the defending warrior remains stationary, and the turn of the attacking warrior continues in accordance with the new token space 90–99, 101 or 107 that the token now resides upon. If the attacking warrior wins one battle and loses one battle, the battle is done over again until either a single or double victory results.

If the defending warrior wins one victory and ties on the other, then its token is moved by the amount of token spaces 90–99, 107 and by the direction associated with dies 80 and 78 respectively. The token of the attacking warrior is held stationary, its turn is ended, and the turn of the next sequential player begins. However, if the defending warrior's token had resided upon a token space 96, then the token would be moved to the first other token space 96 encountered. If no such token space 96 exists, then the token is placed upon either token space 109 or 92, depending upon the direction associated with die 78. That is, if the direction of die 78 is counterclockwise, the token would be moved to space 92 while, if the direction is clockwise, the token would be moved to space 109.

If the defending warrior wins two victories, its token is moved by double the amount of token spaces 90–99, 107 and by the direction associated with dies 80 and 78 respectively. The token of the attacking warrior is held stationary, the turn of the attacking warrior is ended, and the turn of the next sequential player begins. However, if the defending warrior token had resided upon a token space 96, then the token would be moved in a direction associated with die 78 to the second token space 96 encountered in this directed movement. If no such token space 96 exists, then the token is placed upon either token space 92 or 109, depending upon the direction associated with die 78 as defined above. If the color of the token space 97 that the game player initially is made to place his or her token upon in the normal course of turn of play is similar to the color of that player's token, no combat is done. Rather, the token of the game player is moved by an amount of token spaces 90–99 and 107 and by the direction associated with dies 80 and 78 respectively, and his or her play continues in accordance with the new token space 90–99, 101 or 107 that the token now resides upon.

Once a game player has successfully moved his or her token in a clockwise direction upon surface 32(*e*), and more particularly to any of the token spaces 101 thereon, further movement is accomplished only by the winning of a single-handed combat battle in accordance with the aforedescribed methodology. That is, a token upon surface 32(*e*) is never moved unless the player, whose token it is, engages in and wins a single-handed combat battle. Any token upon surface 32(*e*) may never be moved in a counterclockwise manner, and the dies 78 and 80 are disregarded at this point.

A player having a token upon surface 32(*e*) begins his previously defined scheduled game turn by choosing any of the other game players to do single-handed battle with. If the player wins the battle, he or she advances, in a clockwise direction, their token by one token space 101 on surface 32(*e*) and selects any other player, including the previously selected player, to do single-handed combat with. As long as the player wins the battle, his or her turn continues, and the token continues to be moved across surface 32(*e*). This surface 32(*e*) is referred to as "the Hand-to-Hand Combat Zone" by the preferred embodiment of this invention. A player wins the game by winning a single-handed combat battle while having his or her token placed upon token space 99 of surface 32(*e*). Should a player lose such an initiated battle, his or her turn would end, and the turn of the next sequential player would begin. The token would remain in its current position upon surface 32(*e*) and upon the game player's next turn might be moved if the player should win the aforementioned battle. After a player wins the game, all of the other game players bow to the winner as a sign of respect.

It should be apparent to one of ordinary skill in the art that the physical requirements (i.e. hand symbols) of the game methodology of the preferred embodiment of the invention provide for a fast-paced and interesting game. Further, the use of the special token spaces (i.e., inversion token space 98) provides for continued excitement and the possibility of winning the game even if far behind in play.

It is to be understood that the invention is not limited to the exact construction or method illustrated and described above, but that various changes and modifications may be made without departing from the spirit and scope of the invention as defined in the following claims.

We claim:

1. A method for playing a game, said game having a game board, a plurality of game players, and a plurality of tokens associated therewith, said method comprising the steps of:

(a) defining a plurality of hand symbols;
(b) causing two of said plurality of game players to generate one of said plurality of hand symbols; and
(c) selecting said one of said plurality of tokens to be moved by comparing said hand symbols formed by said first and second plurality of game players.

2. The method of claim 1 further comprising the steps of:
(d) rolling a plurality of dice; and
(e) causing one of said plurality of dice to define a direction of said movement of said one of said plurality of tokens upon said game board.

3. The method of claim 2 further comprising the steps of:
(f) defining a first one of said plurality of hand symbols to be a symbol for a rock;
(g) defining a second one of said plurality of hand symbols to be a symbol for paper; and
(h) defining a third one of said plurality of hand symbols to be a symbol for scissors.

4. The method of claim 3 further comprising the step of:
requiring all of said plurality of players to bow to each other before playing said game.

5. The method of claim 4 further comprising the steps of:
assigning a unique one of said plurality of tokens to each of said plurality of game players.

6. A method for playing a game involving a plurality of game players and having a game board and a plurality of tokens associated therewith, said method comprising the steps of:
(a) forming said game board into a pyramid having a large base portion and a pinnacle portion associated therewith;
(b) assigning each of said game players with a unique one of said plurality of tokens;
(c) rolling a plurality of dice;
(d) causing one of said plurality of tokens to be moved upon said game board in a direction defined by a first one of said plurality of dice; and
(e) causing said one of said plurality of token to be move a distance upon said game board, said distance defined by a second one of said plurality of dice;
(f) defining a plurality of hand symbols;
(g) requiring a first one of said plurality of game players to form any one of said plurality of hand symbols;
(h) requiring a second one of said plurality of game players to form any one of said plurality of hand symbols; and
(i) selecting said one of said plurality of tokens to be moved by comparing said hand symbols formed by said first and second plurality of game players.

7. The method of claim 6 further comprising the steps of:
(j) placing a plurality of token spaces upon said game board; and
(k) allowing said plurality of tokens to reside only upon one of said plurality of token spaces.

8. The method of claim 7 further comprising the steps of:
(l) requiring all of said plurality of game players to bow to each other before beginning said play of said game.

9. The method of claim 8 further comprising the steps of:
(m) defining a first one of said plurality of hand symbols to be a symbol of a rock;
(n) defining a second one of said plurality of hand symbols to be a symbol of paper; and
(o) defining a third one of said plurality of hand symbols to be a symbol of scissors.

10. The method of claim 9 further comprising the steps of:
(p) causing a portion of said plurality of token spaces to define a combat zone; and
(q) allowing said plurality of tokens residing within said combat zone to move upon said game board only in response to said hand symbols formed by said first one and said second one of said plurality of game players.

11. A method for playing a game involving a plurality of game players and having a game board and a plurality of tokens associated therewith, said method comprising the steps of:
(a) forming said game board into a pyramid having a large base portion and a pinnacle portion associated therewith;
(b) assigning each of said game players with a unique one of said plurality of tokens;
(c) rolling a plurality of dice;
(d) causing one of said plurality of tokens to be moved upon said game board in a direction defined by a first one of said plurality of dice; and
(e) causing said one of said plurality of token to be move a distance upon said game board, said distance defined by a second one of said plurality of dice.
(f) defining a plurality of hand symbols;
(g) requiring a first one of said plurality of game players to form any one of said plurality of hand symbols;
(h) requiring a second one of said plurality of game players to form any one of said plurality of hand symbols; and
(i) selecting said one of said plurality of tokens to be moved by comparing said hand symbols formed by said first and second plurality of game players.

12. The method of claim 11 further comprising the steps of:
(j) placing a plurality of token spaces upon said game board; and
(k) allowing said plurality of tokens to reside only upon one of said plurality of token spaces.

13. The method of claim 11 further comprising the steps of:
(l) requiring all of said plurality of game players to bow to each other before beginning said play of said game.

14. The method of claim 11 further comprising the steps of:
(m) defining a first one of said plurality of hand symbols to be a symbol of a rock;
(n) defining a second one of said plurality of hand symbols to be a symbol of paper; and
(o) defining a third one of said plurality of hand symbols to be a symbol of scissors.

15. The method of claim 11 further comprising the steps of:
(p) causing a portion of said plurality of token spaces to define a combat zone; and
(q) allowing said plurality of tokens residing within said combat zone to move upon said game board only in response to said hand symbols formed by said first one and said second one of said plurality of game players.

* * * * *